United States Patent [19]

Stafford

[11] Patent Number: 4,462,496

[45] Date of Patent: Jul. 31, 1984

[54] METHOD AND APPARATUS FOR SEPARATING SPHERES FROM NON-SPHERES

[75] Inventor: Duane Stafford, Champaign, Ill.

[73] Assignee: APL Anderson, Inc., Urbana, Ill.

[21] Appl. No.: 482,061

[22] Filed: Apr. 5, 1983

[51] Int. Cl.[3] ..... B07C 7/04

[52] U.S. Cl. ..... 209/643; 209/614; 209/700; 209/703; 209/707; 209/940

[58] Field of Search ..... 209/509, 606, 614, 643, 209/659, 696, 700, 702, 703, 707, 810, 932, 940, 942; 193/2 R

[56] References Cited

U.S. PATENT DOCUMENTS

| | | | |
|---|---|---|---|
| 896,032 | 8/1908 | Maas | 209/643 |
| 1,627,221 | 5/1927 | Wright | 209/643 |
| 2,320,227 | 5/1943 | Frey | 209/940 |
| 2,494,939 | 1/1950 | Nance et al. | 209/707 |
| 2,909,282 | 10/1959 | Simmons et al. | 209/932 |
| 4,123,352 | 10/1978 | Yamamoto et al. | 209/703 |

*Primary Examiner*—Robert B. Reeves
*Assistant Examiner*—Donald Hajec
*Attorney, Agent, or Firm*—L. Lawton Rogers, III

[57] ABSTRACT

A method and apparatus for separating the spheres from the non-spheres in a large number of particles of lamp fill material of substantially equal mass in which the spheres are placed in the grooves of an inclined surface to roll downwardly thereon under the influence of gravity. The grooves are configured to limit the contact with the particles to two points intermediate the depth of the groove so as to keep the particles out of contact with the bottom of the groove. Vacuum pick-up means are used to remove those particles which do not roll down the grooves because of their spherical irregularities. The surfaces in contact with the lamp fill material are made of stainless steel and the entire operation is conducted within the confines of a dry box to minimize contamination.

13 Claims, 10 Drawing Figures

METHOD AND APPARATUS FOR SEPARATING SPHERES FROM NON-SPHERES

BACKGROUND OF THE INVENTION

The present invention relates to a method and apparatus for separating the spheres from the non-spheres in particles of lamp fill material.

Modern high pressure sodium and/or mercury vapor lamps are dosed with lamp fill material which affects the operating characteristics of the lamp, such as its color and brightness. The contamination of the lamp fill material in the manufacturing process or in the dosing of the lamps with the material has a serious deleterious effect upon the lamp. The problems associated with avoiding contamination of the lamp fill material are particularly severe in the mechanized dosing operations required for the commercial production of such lamps.

The advantages of dosing lamps with particulate lamp fill material rather than a liquid are well known. These advantages include ease of handling the material and the fact that the contamination of a solid tends to be limited to the surface thereof rather than spreading throughout. It is, of course, desirable for each dose of lamp fill material to be uniform in mass so that the characteristics of the lamps may be uniform. The uniform shape of the lamp fill material is also necessary if the automatic or semi-automatic dosing machinery is to operate smoothly in performing the dosing operation.

The production of solid particles having a substantially uniform mass and composition is disclosed in the Anderson U.S. Pat. No. 4,216,178, issued Aug. 5, 1980, for "Process for Producing Sodium Amalgam Particles", and in Anderson patent application Ser. No. 207,628, filed Nov. 17, 1980, for "Method for Producing Large Diameter High Purity Sodium Amalgam Particles" issued as U.S. Pat. No. 4,419,303. By the use of such technology, controlled spheres having a normal mass distribution with a standard deviation typically five percent of the mean mass, typically three to five mg., can be produced.

However, there are things which can happen during a production run to upset the controlled formation of spheres. Control of particle size may also require adjustment during the initial start-up and final termination stages of the production process. Examples of such types of unacceptable particles are illustrated in FIGS. 4(*a*)–4(*e*) of this application.

Such unsatisfactorily shaped particles, referred to herein as "non-spheres", are mixed, of course, with the true spheres in the manufacturing process. There is a great tendency for such non-spheres to jam up a lamp dosing device by clogging a fill tube, refusing to roll, or even breaking apart, because of the very close dimensional tolerances of arc tube dosing machinery. Even though the particles are sieved to remove those particles of excessively large or small size, there generally remain non-spheres which will result in non-uniform lamp dosing and/or jamming of the dosing machinery. The period of time required by frequent un-clogging of the machinery often negates the higher production rates associated with the automatic dosing equipment.

It is thus a practical necessity to separate spheres from non-spheres prior to loading the dosing apparatus, and to do so in a dry box because of the ease of contamination. One of the prior art separation methods is the manual method of rolling particles on a flat or roughened surface. This "rough" surface method may be performed in a dry box, but requires a great many hand movements, is intolerably slow, and requires close visual examination, all of which result in severe operator strain.

Another known method of separating spheres from non-spheres is known as the "beaker" method in which the beaker is tipped on its side and the beaker wall serves as a rather shallow groove. Because the radius of curvature of the single groove is excessively large in comparison to the size of the spheres, some non-spheres such as the "twins" illustrated in FIG. 4(*a*), are not easily separated. Again, close visual examination and many hand movements are required which result in operator strain.

In another known method such as that disclosed in the Simmons et al U.S. Pat. No. 2,909,282, dated Oct. 20, 1959, in which the particles are placed on an inclined grooved surface with the expectation that only the spheres will roll through the grooves. In such systems, the grooved surface is a grooved endless conveyer which is moved transverse to the direction of the grooves so that the non-rolling non-spheres entering the grooves are moved transversely and dumped as the conveyor circulates. This method, while fully automatic, is not suitable for operation with lamp fill material for a number of reasons, including the relative short length of the grooves, the fact that spheres that collect behind a non-sphere are discarded with the non-sphere resulting in unacceptable yields, contamination of the particles by the conveyor material, and vibration from conveyor movement which tends to cause non-spheres to slide and, thus, pass through the grooves.

It is, accordingly, an object of the present invention to provide a novel method and apparatus for separating the spheres from the non-spheres in a large number of particles of lamp fill material.

It is a further object of the present invention to provide a novel method and apparatus suitable for use in a dry box for separating spheres from non-spheres.

It is a further object of the present invention to provide a novel method and apparatus for separating spheres from non-spheres while limiting the effects on the process of dust and/or small fragments of the particles.

It is yet a further object of the present invention to provide a novel method and apparatus for manually eliminating the non-spheres from the spheres within a dry box without risk of contamination of either the spheres or the non-spheres.

These and other objects and advantages will be readily apparent to one skilled in the art to which the invention pertains from a reading of the following detailed description when read in conjunction with the appended drawings.

DESCRIPTION OF THE PREFERRED EMBODIMENT

Figure 1:
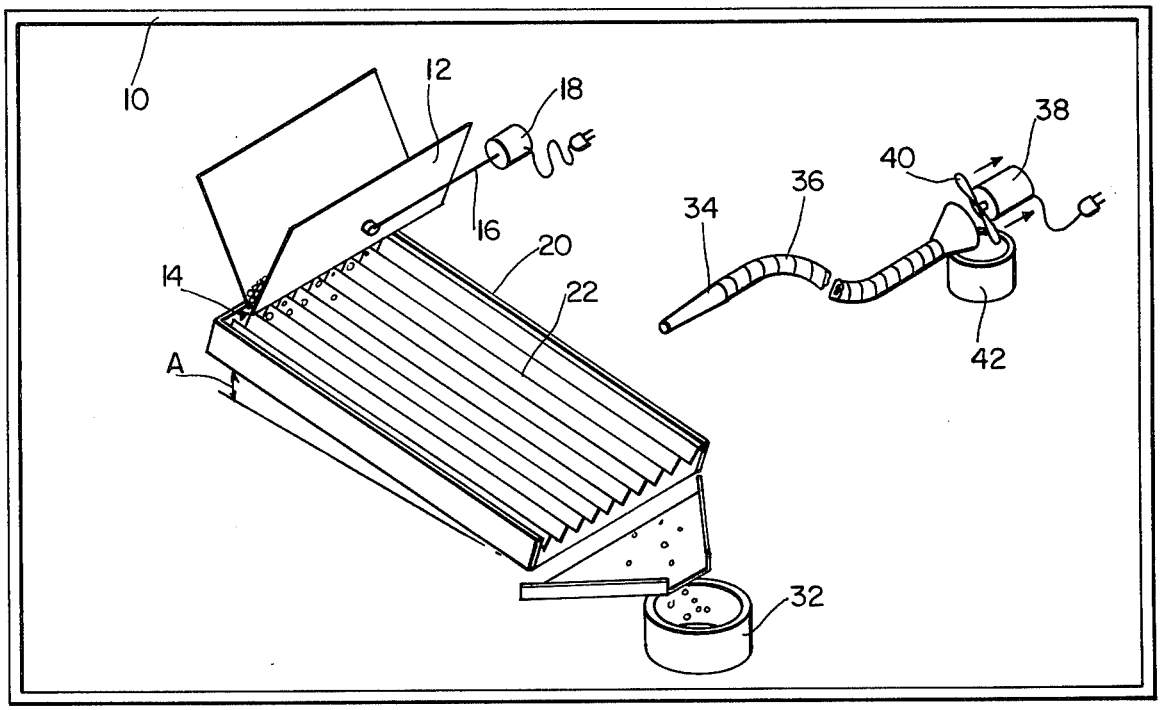
FIG. 1 is a schematic representation of one embodiment of the present invention.

With reference to FIG. 1, the apparatus of the present invention is schematically illustrated as being contained within the confines of a conventional dry box 10. As shown in FIG. 1, the apparatus may include a hopper 12 of conventional configuration having an elongated opening 14 at the bottom thereof. The hopper may be vibrated continuously or at periodic intervals by any suitable conventional means, such as a rod 16 driven by an electrical motor 18 in either a reciprocating fashion or by means of a eccentric cam. The vibrating of the hopper serves to eliminate the occasional "bridging" of the particles within the hopper and to insure a random but substantially even distribution of particles through the opening 14 along the length thereof.

With continued reference to FIG. 1, the particles exiting the elongated opening 14 in the bottom of the hopper 12 are placed thereby on the upper end 20 of a generally planar surface 22. The surface 22 has a plurality of parallel grooves extending substantially the length thereof. It is important that the length thereof be between 75 and 150 times the diameter of the particles intended to be separated thereby, and preferably 100 times the diameter of such particles. The surface 22 is inclined to the horizontal at an angle A between about one degree and fifteen degrees, and preferably between about two degrees and about five degrees.

Figure 2A:
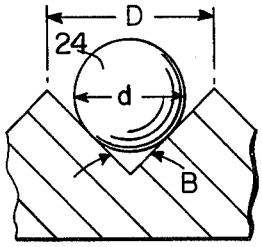
FIGS. 2(*a*)–2(*c*) are elevations in cross section of a portion of the grooved surface shown in FIG. 1 illustrating the shape of the groove and the relationship between the particle and the groove.
Figure 2B:
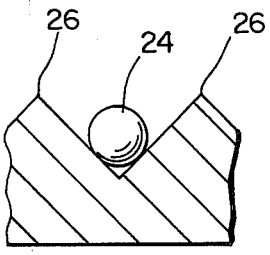
Figure 2C:
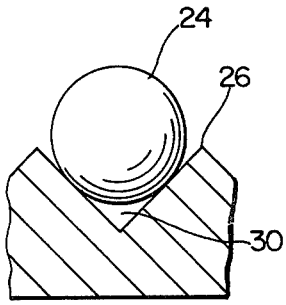
Figure 3:
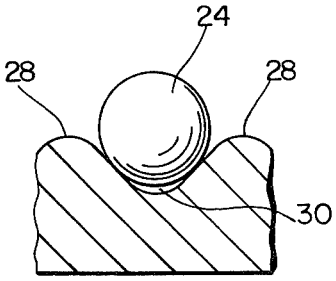
FIG. 3 is an elevation in cross section of a second embodiment of the inclined surface of FIG. 1 illustrating a different groove configuration.
Figure 4A:
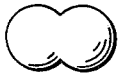
FIGS. 4(*a*)–(*e*) is a pictorial representation of typical forms of non-spheres which may be removed by the present invention.
Figure 4B:
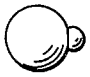
Figure 4C:
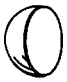
Figure 4D:
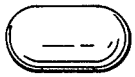
Figure 4E:
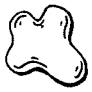

The grooves in the generally planar surface 22 may be of a variety of shapes. As illustrated in FIG. 2, the cross sectional configuration presented by the surface 22 may be that of a saw tooth or triangular waveform. In the embodiment illustrated in FIG. 3, the cross section of the planar surface 22 may be a generally sinusoidal waveform.

The effective angle B of the two sides of the groove is between about 45 and about 315 degrees, and preferably 90 degrees.

It is, however, important that the maximum distance D of the grooves as shown in FIG. 2(*a*) be larger than the diameter d of a particle expected to pass therethrough. Different relative sizes of particles and grooves are illustrated in FIGS. 2(*b*) and 2(*c*). However, it is important that the maximum diameter d of the particle be less than the distance D of the opening of the groove so that the particle 24 is supported within the groove by the sides thereof rather than extreme upper surfae, such as the peaks 26 of the saw tooth waveform illustrated in FIG. 2 or the apices 28 of the sinusoidal configuration illustrated in FIG. 3.

It is also desirable that the maximum opening at the top of the groove be not more than about 150 percent of the diameter d of the particles 24 so that there is a space 30 as illustrated in FIGS. 2(*c*) and 3 at the very bottom of the groove. This space 30 provides a space where small fragments of particles and "dust" resulting from the abrasion of the particles with each other or with other apparatus may be accumulated out of contact with the particles 24 as they roll down the grooves.

For V-shaped grooves with a 90 degree junction, the depth of the groove should be between about 50 percent and about 200 percent of particle diameter. For U-shaped or semi-circular grooves, the width should be between about 125 percent to about 150 percent of particle diameter.

Because of the space 30 in the bottom of the V-shaped groove, the V-shaped groove will pass particles having somewhat greater eccentricity than the U-shaped groove. Since some slight eccentricity can generally be tolerated, the V-shaped groove is preferable.

The typical shape of the spheres which will not roll down the grooves in the generally planar surface 22 are illustrated in FIGS. 4(*a*)–4(*e*) and are catalogued generally as "twins", "buds", "half-shells", "elipsoids", and "irregulars", respectively. The spheres and the smooth, round pieces only slightly elipsoidal in shape will roll freely down the grooves and may be collected in a beaker 32. Since the grooves confine the non-spheres in an orientation in which they cannot roll, the non-spheres stay on the surface 22. These non-rolling non-spheres obstruct the movement of spheres in that same groove which will back up behind the non-sphere and thus immediately call the attention of the operator to the presence of the non-sphere. Once a blocking non-sphere is removed, the spheres previously stopped behind the non-sphere will continue to roll down the groove under the influence of gravity.

With continued reference to FIG. 1, the non-spheres may be removed from the generally planar surface 22 by means of a vacuum tool of any suitable conventional design. As illustrated in FIG. 1, the vacuum tool may comprise a nozzle 34 adapted to be manually grasped, connected by way of a hose 36 to an aperture through which the inert atmosphere of the dry box 10 may be drawn under the influence of a motor 38 driven impeller 40. Thus, the suction is provided by the recirculation of the inert atmosphere of the dry box and no contamination results of the spheres or non-spheres.

In operation, the operator may manually position the free end of the nozzle 34 in proximity to a non-sphere on the surface 22. The diameter of the nozzle 34 and hose 36 is such that the particle will reduce the effective cross section of the passageway sufficiently to create a negative pressure and to cause the non-sphere to pass through the nozzle 34 and hose 36 to a suitable collection container, such as beaker 42.

The use of the apparatus described above is fast and results in complete separation of the spheres from the non-spheres. In addition, the apparatus is easily operated within minimum strain on the operator. By use of the present method and apparatus, the time necessary to effect separation of the spheres from the non-spheres in two kilograms of lamp fill material has been reduced from about two days by the "rough surface" method and about four days for the "beaker" separation method to less than two hours, often less than one hour, with a reduction in the amount of discarded spheres from about 20–30 percent to 1–10 percent.

These and many other advantages will be apparent from the claims and it is to be understood that the foregoing is a description of a preferred embodiment, that many modifications will occur to those skilled in the art, and that the invention is limited to the language of the following claims when accorded a full range of equivalents.

What is claimed is:

1. Apparatus for separating the spheres from the non-spheres in a large number of particles of lamp fill material of substantially equal mass and a mean diameter between about 900 microns and about 1500 microns comprising:

(a) a dry box;

(b) a hopper within said dry box, said hopper having an elongated opening in the bottom thereof and being made of stainless steel to reduce the likelihood of contamination of the particles by contact therewith;

(c) a generally planar surface within said dry box, said surface having a plurality of parallel grooves, each of said grooves being generally V-shaped in cross section, uniform over the length thereof and open at the upper extremity thereof a distance between about 100 percent and about 150 percent of particle diameter with substantially planar sides converging at an angle of approximately ninety degrees at the bottom of said grooves to thereby limit the contact of grooves with a particle placed therein to a relative small area of said substantially planar sides intermediate the top and bottom of said groove and eliminate contact between the particle and the bottom of said groove, the length of said grooves being not less than about 75 times the maximum width of said grooves, said surface being made of stainless steel to reduce the likelihood of contamination of said particles by contact therewith, said surface being disposed at an angle to the horizontal between about two degrees and about five degrees to incline said grooves to the horizontal with the upper end thereof underlying the elongated opening in the bottom of said hopper so that particles exiting said elongated opening in the bottom of said hopper along the length thereof will be deposited on said surface in one of said plurality of grooves at the upper end thereof in position to roll down said surface in one of said grooves;

(d) means within said dry box for vibrating said hopper without vibrating said surface, the vibrating being sufficient to cause particles placed in said hopper to exit the opening in the bottom thereof; and (e) vacuum pick-up means within said dry box, said means including an electric motor, an impeller, a hose and a manually positionable nozzle operatively connected so that the atmosphere within said dry box drawn into said nozzle and through said hose by said impeller when driven by said motor creates a vacuum at the free end of said nozzle whereby particles which do not roll the length of said grooves may be selectively removed from said surface through said nozzle and said hose by the manual positioning of the free end of said nozzle in proximity thereto.

2. Apparatus for separating the spheres from the non-spheres in a large number of particles of lamp fill material of substantially equal mass comprising:

a dry box;

a hopper within said dry box;

a generally planar surface within said dry box, said surface having a plurality of parallel grooves, each of said grooves being uniform over the length thereto and open at the upper extremity thereof a distance between about 100 percent and 150 percent of particle diameter and configured to limit the contact of grooves with a particle placed therein to a relative small area intermediate the top and bottom of said groove, said surface being disposed at an angle to the horizontal between about one degree and fifteen degrees with the upper end thereof underlying said hopper so that particles exiting said hopper will be deposited on said surface in position to roll down one of said grooves under the influence of gravity; and vacuum pick-up means within said dry box, said means including a manually positionable nozzle whereby particles which do not roll the length of said grooves may be selectively removed from said surface by the manual positioning of the free end of said nozzle in proximity thereto.

3. The apparatus of claim 2 wherein each of said grooves is V-shaped in cross section and converge at an angle between about 75 degrees and about 105 degrees.

4. The apparatus of claim 2 wherein each of said grooves is generally sinusoidal in cross section.

5. The apparatus of claim 2 wherein each of said grooves is semi-cylindrical in cross section with a diameter between about 125 percent and 150 percent of particle diameter.

6. The apparatus of claim 2 wherein each of said grooves is configured to maintain a particle out of contact with the bottom thereof.

7. The apparatus of claim 2 wherein said hopper and said surface are made of stainless steel to avoid contamination of the particles.

8. The apparatus of claim 2 wherein the angle of inclination of said surface is between about two degrees and about five degrees to the horizontal.

9. The apparatus of claim 2 wherein the minimum length of said grooves is about seventy-five times particle diameter.

10. The apparatus of claim 2 including means for vibrating said hopper sufficiently to overcome bridging of particles within said hopper.

11. A method for separating the spheres from the non-spheres in a large number of particles of lamp fill material of substantially equal mass comprising the steps of:

(a) providing a generally planar surface within a dry box with the surface having a plurality of parallel grooves open at the upper extremity thereof a distace between about 100 percent and 150 percent of the diameter of the particles to be separated with generally converging sides;

(b) inclining the surface at an angle to the horizontal between about one degree and about fifteen degrees;

(c) depositing the particles to be separated on the surface in one of the grooves at the upper end thereof in position to roll down the groove under the influence of gravity;

(d) providing vacuum pick-up means within the dry box; and (e) selectively removing particles which do not roll the length of said grooves from said surface but retained in the dry box by the manual positioning of the vacuum pick-up means in proximity thereto.

12. The method of claim 10 wherein the grooves in the inclined surface are configured to limit the contact of the groove with a particle placed therein to a relative small area intermediate the top and bottom of the groove and eliminate contact between the particle and the bottom of the groove.

13. The method of claim 10 including the step of vibrating the hopper without vibrating the surface.

* * * * *